United States Patent [19]

Takano

[11] 4,452,673

[45] Jun. 5, 1984

[54] PRETREATMENT BATHS FOR SILVER PLATING

[75] Inventor: Satoshi Takano, Osaka, Japan

[73] Assignee: Sumitomo Electric Industries, Ltd., Osaka, Japan

[21] Appl. No.: 478,881

[22] Filed: Mar. 23, 1983

Related U.S. Application Data

[62] Division of Ser. No. 349,980, Feb. 18, 1982.

[30] Foreign Application Priority Data

Feb. 23, 1981 [JP] Japan ..... 56-25746

[51] Int. Cl.[3] ..... C25D 5/34; C25D 5/36; C25D 5/40

[52] U.S. Cl. ..... 204/29; 204/46 R

[58] Field of Search ..... 204/29, 32 R, 46 R

[56] References Cited

U.S. PATENT DOCUMENTS 2,525,567 10/1950 Tucker et al. ..... 204/46

4,153,519 5/1979 Suzuki et al. ..... 204/40

4,177,114 12/1979 Suzuki et al. ..... 204/38 B 4,247,372 1/1981 Nobel ..... 204/15

FOREIGN PATENT DOCUMENTS 2450937 6/1976 Fed. Rep. of Germany .... 204/46 R 807172 1/1959 United Kingdom ..... 204/46 R

OTHER PUBLICATIONS

Handbook of Chemistry and Physics, 55th Edition, CRC Press, 1974, pp. C-231-232, C-489-490.

*Primary Examiner*—Howard S. Williams

*Assistant Examiner*—William Leader

*Attorney, Agent, or Firm*—Wenderoth, Lind & Ponack

[57] ABSTRACT

Pretreatment baths for silver plating are proposed which include dithiocarbamic acids or their salts and/or thiosemicarbazides or their salts. They are effective in preventing the immersion plating in the subsequent silver plating.

2 Claims, No Drawings

PRETREATMENT BATHS FOR SILVER PLATING

This is a divisional of application Ser. No. 349,980, filed Feb. 18, 1982.

The present invention relates to pretreatment baths used prior to the electroplating of silver on a substrate such as copper, nickel, iron and their alloys, to prevent the immersion plating of silver on the substrate in the silver plating.

In fields where good adhesion and heat resistance are required for the plating, a conventional process for plating silver on such substrates was to firstly perform what is called the strike plating, that is, plating a thin layer from a plating bath having a low silver concentration, and then plating to a required thickness from an ordinary plating bath having a high silver concentration. This is mainly because if silver plating from an ordinary high-concentration bath were done without the strike plating, silver having a poor adhesion would deposit by metal replacement at the initial stage of plating, thus impairing the adhesion and heat resistance of the silver plating. Also, the bath for strike plating, too, causes a considerable amount of silver to be plated by replacement on the substrate. Secondly, the substrate had to be immersed into the bath with a voltage preapplied thereto. Further, even splashes from the bath for strike or ordinary plating caused the immersion plating, thus smearing the portions not to be plated and incurring the loss of silver.

A pretreatment bath for silver plating for the same purpose as the present invention has been proposed in U.S. Pat. No. 4,247,372. The bath contains mercaptan, but is not sufficiently effective in preventing the immersion plating, as will be shown later in Example 3.

An object of the present invention is to provide pretreatment baths for silver plating which solves the above-mentioned problems and which markedly suppresses immersion plating in the silver plating step on a substrate of copper, nickel, iron or their alloys and makes it possible to provide a silver plating with good adhesion and heat resistance without the necessity of doing the strike plating.

In accordance with the present invention, there are provided pretreatment baths for silver plating on a substrate of copper, nickel, or iron or their alloys, said baths containing at least one selected from the group consisting of dithiocarbamic acids and their salts, and thiosemicarbazides and their salts, whereby preventing the immersion plating of silver.

The pretreatment baths according to the present invention are effective particularly for silver plating on substrates of copper or its alloys which would otherwise cause a violent immersion plating in an ordinary silver plating bath.

The dithiocarbamic acids and their salts or thiosemicarbazides and their salts adsorb on the surface of the substrate, forming a film which shows a marked effect in preventing the immersion plating.

When used in combination with silver plating baths which contain silver in the form of cyanides and are alkaline with the cyanides, the pretreatment baths according to the present invention serve to substantially completely prevent immersion plating without losing the advantages of the conventional silver plating bath containing cyanides so that a smooth plating with no pin holes is achieved with a high current density.

However, the pretreatment bath in accordance with the present invention is not so effective if the silver plating bath used has a higher concentration of free cyanides than 60 g/l.

In the present invention, it is also preferable to add dithiocarbamic acid and/or thiosemicarbazide as a replacement preventive agent to an alkaline silver plating bath having a free cyanide concentration of 0–60 g/l and use the mixture instead of using them separately.

Dithiocarbamic acids have a general formula:

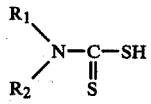

in which R represents hydrogen or hydrocarbon radicals.

Thiosemicarbazides have a general formula:

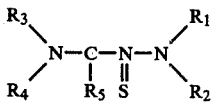

in which R represents hydrogen or hydrocarbon radicals.

Because dithiocarbamic acids are generally unstable, they should be used in the form of salts such as sodium, potassium or ammonium salts. If used in the form of such salts, they have been found to be as effective as when they are used in the form of acids.

The term "dithiocarbamic acids" used in the present invention should be interpreted to include diethyldithiocarbamic acid, dimethyldithiocarbamic acid, N-methyldithiocarbamic acid, ethylene-bisdithiocarbamic acid, dithiocarbamic acid, and dibutyldithiocarbamic acid, and their salts. Among them, the first four acids and their salts are particularly effective.

The term "thiosemicarbazides" used in the present invention should be interpreted to include 4-ethyl-3-thiosemicarbazide, 4-naphtyl-3-thiosemicarbazide, 1,4-diphenyl-3-thiosemicarbazide, 1-methyl-4-phenyl-3-carbazide, and 1-methyl-4-ethyl-3-thiosemicarbazide, and their salts. They do not appreciably differ from one another in the effect for preventing the immersion plating.

For use for the pretreatment bath in the present invention, the dithiocarbamic acids in the form of salts have only to be dissolved in water or alcohol. In contrast, thiosemicarbazides, which are almost insoluble in water, have to be dissolved in an aqueous solution of salts such as sodium chloride, acids, or alkali, or in an organic solvent such as acetone, though they do not have to be in the form of their salts.

The concentration of the dithiocarbamic acid and/or thiosemicarbazide in the pretreatment bath in accordance with the present invention is not limited specifically. However, in consideration of the required life and stability of the bath and the effect on unevenness in color of the silver plating, it should be 0.05–1 g/l for sodium diethyldithiocarbamate and 0.02–0.1 g/l for 4-ethyl-3-thiosemicarbazide, for example.

The dithiocarbamic acid and thiosemicarbazide adsorb on the surface of the substrate in the pretreatment bath, forming a film to prevent the immersion plating of silver. But, too thick a film could have unfavorable effects e.g. unevenness in color of the silver plating. It is preferable to add a free cyanide such as potassium cyanide or a silver salt such as potassium silver cyanide to the pretreatment bath according to the present invention in order to prevent the formation of too thick a film. Particularly the addition of such a silver salt has another favourable effect. If it is added, because immersion plating is almost complete while the substrate is immersed in the pretreatment bath, the elution from the substrate due to the immersion plating in the silver plating bath is substantially suppressed, thereby considerably decreasing the contamination of the silver plating bath.

In accordance with the present invention, after having been immersed in the pretreatment bath, the substrate is immersed in a silver plating bath for silver plating without doing the strike plating.

In accordance with the present invention, the substrate metal has only to be immersed in the pretreatment bath at normal temperature for 3–30 seconds. The substrate metal undergoes conventional pretreatments such as degreasing by alkali electrocleaning and pickling before the immersion in the pretreatment bath of the present invention. Before the immersion, it may be undercoated with nickel, copper, etc. Also, it is preferable to rinse the substrate metal after the immersion in the pretreatment bath.

As for the silver plating bath used after pretreatment in the pretreatment bath according to the present invention, a cyanide-alkaline bath containing 0–60 g/l of free cyanide should preferably be used, as mentioned before. The reason for such limitation is that even if the pretreatment bath of the present invention is used, a violent immersion plating is inevitable in a silver plating bath containing free cyanide in the amount of 60 g/l or more.

Cyanide-alkaline baths for silver plating are solutions containing mainly silver cyanide and an alkali cyanide such as potassium cyanide, or an alkali silver cyanide such as potassium silver cyanide and an alkali cyanide. However, with such solutions having a free cyanide concentration of 0–60 g/l, it is difficult to obtain a silver plating having uniform characteristics because of small electric conductivity of the plating bath and a considerable change in pH of the bath and in the concentration of the free cyanide. The addition of a phosphate such as potassium dihydrogen phosphate and a pyrophosphate such as potassium pyrophosphate is preferable to increase the electric conductivity and suppress the change in pH of the bath and in the free cyanide concentration.

The conditions for silver plating are not particularly limited, but the following ranges are preferable in consideration of the appearance of the plating obtained and the stability of the bath. Preferably, the concentration of silver in the plating bath is 30–60 g/l; the concentration of phosphate or pyrophosphate is 80–300 g/l; pH of the bath is 7.8–9.5; the bath temperature is 10°–70° C.; and the flow rate of the bath is 0–20 m/sec. The optimum current density varies widely, depending upon these conditions. Some are shown in the Examples.

A brightner such as carbon disulfide, potassium antimonyl citrate or potassium selenocyanate and/or a surface active agent such as poly-(ethylene glycol) nonylphenylether may be added to the plating bath, if desired.

Although in the foregoing description only cyanide-alkaline plating baths have been named as the plating bath to be used after pretreatment, other silver plating baths such as silver thiocyanate solution and silver thiosulfate solution may be used. In other words, the pretreatment bath according to the present invention can be used in combination with such other plating baths.

To further illustrate this invention, and not by way of limitation, the following examples are given.

EXAMPLE 1

Terminal pins of phosphorus bronze were plated with silver only at their tip. After ordinary pretreatments, the pins were immersed for 5 seconds in an aqueous solution containing 1 g/l of sodium diethyldithiocarbamate. They were then silver plated from a plating solution, the composition of which was as follows:

| | |
|---|---|
| $KAg(CN)_2$ | 120 g/l |
| $K_2HPO_4$ | 90 g/l |
| KCN | 30 g/l |
| Thiosalicylic acid | 0.5 g/l |
| KSeCN | 0.01 g/l |

pH was 9.3, current density was 20 A/dm$^2$, and the bath temperature was 50° C. Although the portion not to be plated was splashed with the plating solution, it remained unchanged in color. Immersion plating hardly occurred. The plated surface was white and lusterless. No blisters were observed thereon after heating at 400° C. for 2 minutes in the atmosphere.

EXAMPLE 2

After being degreased with acetone and pickled with nitric acid, three sheets of non-oxygen copper foil 50 microns thick were immersed for one minute in a pretreatment bath according to the present invention. Its composition was as follows:

| | |
|---|---|
| $KAg(CN)_2$ | 100 g/l |
| $K_2HPO_4$ | 100 g/l |
| KCN | 40 g/l |
| 1-methyl-4-ethyl-3-thiosemicarbazide | 0.5 g/l |

The pH of the bath was 10.0 and its temperature was 40° C. Among three pretreated foils, one was kept for analysis (Sample A) and another was immersed for one minute in a silver plating bath, the composition of which was as follows:

| | |
|---|---|
| $KAg(CN)_2$ | 100 g/l |
| $K_2HPO_4$ | 100 g/l |
| KCN | 10 g/l |

The pH of the bath was 8.0 and its temperature was 50° C. The foil thus plated is referred to as Sample B.

Analysis of the samples A and B showed that the amount of silver plated by immersion plating was 0.013 mg/cm$^2$ and 0.016 mg/cm$^2$, respectively.

The third foil was silver plated to a thickness of 5 microns with a current density of 15 A/dm$^2$ in the same bath for the sample B. A white, lusterless, good plating was obtained and no blister was observed after heating for 2 minutes at 400° C. in the atmosphere.

EXAMPLE 3

After being degreased with acetone and pickled with nitric acid, non-oxygen copper foils 50 microns thick were immersed in various pretreatment baths shown in Table 1 wherein the baths Nos. 1–11 are comparison ones and the baths Nos. 12–16 are the ones according to the present invention. Thereafter, they were immersed for 1 minute in a silver plating bath, the composition of which was as follows:

| | |
|---|---|
| KAg(CN) 2 | 100 g/l |
| $K_2HPO_4$ | 90 g/l |
| KCN | 20 g/l |

The pH of the bath was 9.0 and its temperature was 60° C. The plated sample was dissolved in nitric acid and analysed for silver. The amount of silver plated by replacement was as shown in Table 1.

The Table shows that the pretreatment baths according to the present invention containing dithiocarbamic acid and/or thiosemicarbazide are much more effective to prevent the immersion plating than the comparison baths.

TABLE 1

| Bath No. | Compound in bath | Conc. (g/l) | Amount of silver replaced ($mg/cm^2$) |
|---|---|---|---|
| 1 | 1,2,3-benzotriazole | 0.1 | 0.1 or more |
| 2 | " | 1 | " |
| 3 | Benzimidazole | " | " |
| 4 | Thiourea | " | " |
| 5 | Potassium ethylxanthate | " | " |
| 6 | Thioglycolic acid | 0.01 | " |
| 7 | " | 1 | " |

TABLE 1-continued

| Bath No. | Compound in bath | Conc. (g/l) | Amount of silver replaced ($mg/cm^2$) |
|---|---|---|---|
| 8 | Thiomalic acid | 0.1 | " |
| 9 | " | 2 | " |
| 10 | 8-hydroxyquinoline | 1 | " |
| 11 | 3-amino-1,2,4-triazole | " | " |
| 12 | Sodium diethyldithiocarbamate | 0.01 | 0.032 |
| 13 | Sodium diethyldithiocarbamate | 0.1 | 0.025 |
| 14 | Sodium N—methyldithiocarbamate | 0.1 | 0.034 |
| 15 | 4-ethyl-3-thiosemicarbazide | 0.1 (+NaCl 10 g/l) | 0.061 |
| 16 | Potassium dibutyldithiocarbamate + 1-methyl-4-ethyl-3-thiosemicarbazide | 0.2 + 0.2 | 0.03 |

What we claim:

1. A process for silver plating on a substrate of copper, nickel or iron or their alloys, comprising immersing said substrate in a pretreatment bath containing at least one compound selected from the group consisting of dithiocarbamic acids and their salts and thiosemicarbazides and their salts and thereafter electroplating silver onto said substrate from a silver plating bath.

2. A process according to claim 1 wherein said dithiocarbamic acid is selected from the group consisting of diethyldithiocarbamic acid, dimethyldithiocarbamic acid, N-methyldithiocarbamic acid and ethylene-bisdithiocarbamic acid and a thiosemicarbazide selected from the group consisting of 4-ethyl-3-thiosemicarbazide, 4-napthyl-3-thiosemicarbazide, 1,4-diphenyl-3-thiosemicarbazide, 1-methyl-4-phenyl-3-thiosemicarbazide and 1-methyl-4-ethyl-3-thiosemicarbazide.

* * * * *